US008942393B2

(12) United States Patent
Yamauchi et al.

(10) Patent No.: US 8,942,393 B2
(45) Date of Patent: Jan. 27, 2015

(54) PIEZOELECTRIC SOUND COMPONENT

(75) Inventors: Masakazu Yamauchi, Nagaokakyo (JP); Toshio Imanishi, Nagaokakyo (JP)

(73) Assignee: Murata Manufacturing Co., Ltd., Nagaokakyo-Shi, Kyoto-fu (JP)

( * ) Notice: Subject to any disclaimer, the term of this patent is extended or adjusted under 35 U.S.C. 154(b) by 499 days.

(21) Appl. No.: 13/336,169

(22) Filed: Dec. 23, 2011

(65) Prior Publication Data

US 2012/0163638 A1 Jun. 28, 2012

(30) Foreign Application Priority Data

Dec. 27, 2010 (JP) ..... 2010-289289

(51) Int. Cl.

| | |
|---|---|
| ***H04R 25/00*** | (2006.01) |
| ***H04R 17/00*** | (2006.01) |
| ***H04R 7/18*** | (2006.01) |
| *H04R 7/10* | (2006.01) |

(52) U.S. Cl.

CPC ..... *H04R 17/00* (2013.01); *H04R 7/18* (2013.01); *H04R 2400/11* (2013.01); *H04R 7/10* (2013.01)

USPC ..... 381/173; 381/190

(58) Field of Classification Search

CPC ..... H04R 15/00; H04R 17/00; H04R 17/02; H04R 17/005; H04R 19/00; H04R 19/005; H04R 19/016; H04R 19/04; H04R 25/00; H04R 1/222; H04R 7/045; H04R 21/02; H04R 2499/11

USPC ..... 381/173, 190

See application file for complete search history.

(56) References Cited

U.S. PATENT DOCUMENTS

| | | | | |
|---|---|---|---|---|
| 3,894,198 | A * | 7/1975 | Murayama et al. | 381/190 |
| 6,744,180 | B2 | 6/2004 | Nakamura et al. | |
| 6,965,680 | B2 | 11/2005 | Yamauchi et al. | |
| 7,531,946 | B2 | 5/2009 | Yamauchi et al. | |
| 2003/0107300 | A1 | 6/2003 | Nakamura et al. | |
| 2012/0057730 | A1 | 3/2012 | Fujise et al. | |

FOREIGN PATENT DOCUMENTS

| | | | |
|---|---|---|---|
| CN | 1413002 | A | 4/2003 |
| JP | 2004-007400 | A | 1/2004 |
| JP | 2006-303770 | A | 11/2006 |
| JP | 4203911 | B2 | 1/2009 |
| WO | WO-2010/137242 | A1 | 12/2010 |

* cited by examiner

*Primary Examiner* — Brian Ensey

(74) *Attorney, Agent, or Firm* — Dickstein Shapiro LLP

(57) ABSTRACT

A piezoelectric sound component that includes a resin sheet, a piezoelectric diaphragm, and a casing. The piezoelectric diaphragm vibrates by bending, and is attached to at least part of a central portion of the resin sheet excluding a peripheral portion of the resin sheet. The casing holds the peripheral portion of the resin sheet. The casing supports at least one corner portion of the piezoelectric diaphragm.

15 Claims, 7 Drawing Sheets

PIEZOELECTRIC SOUND COMPONENT

BACKGROUND OF THE INVENTION

1. Field of the Invention

The present invention relates to a piezoelectric sound component employing a piezoelectric vibrator that vibrates by bending.

2. Description of the Related Art

Piezoelectric sound components employing piezoelectric vibrators are known. For example, Japanese Patent No. 4203911 describes a piezoelectric sound component in which a casing holds a peripheral portion of a resin film and a piezoelectric diaphragm that is smaller than the resin film is attached to a central portion of the resin film.

If the piezoelectric sound component described in Japanese Patent No. 4203911 is to have a better sound quality in a low frequency band, the sound pressure in the low frequency band needs to be increased. With the piezoelectric sound component described in Japanese Patent No. 4203911, however, it is difficult to increase the sound pressure in the low frequency band by an amount sufficient to improve the sound quality.

SUMMARY OF THE INVENTION

Accordingly, it is an object of the present invention to provide a piezoelectric sound component that produces a sound having a high sound pressure in the low frequency band.

According to a preferred embodiment of the present invention, a piezoelectric sound component includes a resin sheet, a substantially polygonal piezoelectric diaphragm, and a casing. The piezoelectric diaphragm vibrates by bending. The piezoelectric diaphragm is attached to at least part of a central portion of the resin sheet excluding a peripheral portion of the resin sheet. The casing holds the peripheral portion of the resin sheet. The casing supports a corner portion of the piezoelectric diaphragm.

In a piezoelectric sound component according to a specific aspect of the present invention, the casing includes a first casing portion and a second casing portion. The first casing portion is disposed on the piezoelectric diaphragm side of the resin sheet and the second casing portion is disposed on a side of the resin sheet that is opposite to the piezoelectric diaphragm side. The second casing portion and the first casing portion hold therebetween the peripheral portion of the resin sheet. The second casing portion is superposed with the corner portion of the piezoelectric diaphragm. The first casing portion is not superposed with the corner portion of the piezoelectric diaphragm. This configuration prevents the piezoelectric diaphragm from being damaged.

In a piezoelectric sound component according to another specific aspect of the present invention, the piezoelectric diaphragm is substantially rectangular.

According to the preferred embodiment and the aspects of the present invention, it is possible to provide a piezoelectric sound component that produces a sound having a high sound pressure in the low frequency band.

Other features, elements, characteristics and advantages of the present invention will become more apparent from the following detailed description of preferred embodiments of the present invention with reference to the attached drawings.

DESCRIPTION OF THE PREFERRED EMBODIMENTS

Hereinbelow, preferred embodiments of the present invention will be described by taking a piezoelectric sound component 1 illustrated in FIGS. 1 and 2 as an example. Note that the piezoelectric sound component 1 is merely an example. Piezoelectric sound components according to preferred embodiments of the present invention are in no way limited to the piezoelectric sound component 1.

Figure 1:
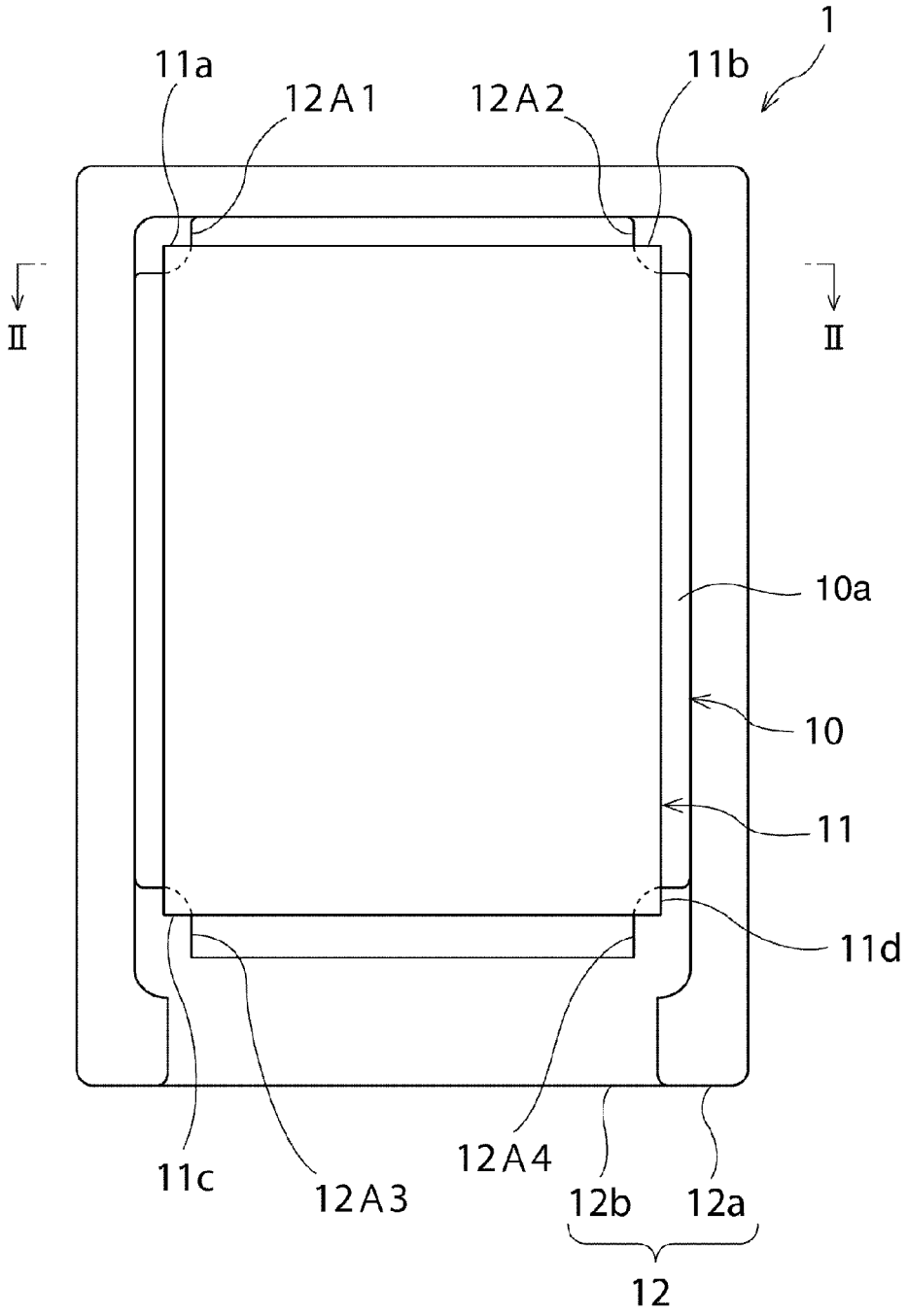
FIG. 1 is a schematic sectional view of a piezoelectric sound component according to an embodiment of the present invention.
Figure 2:
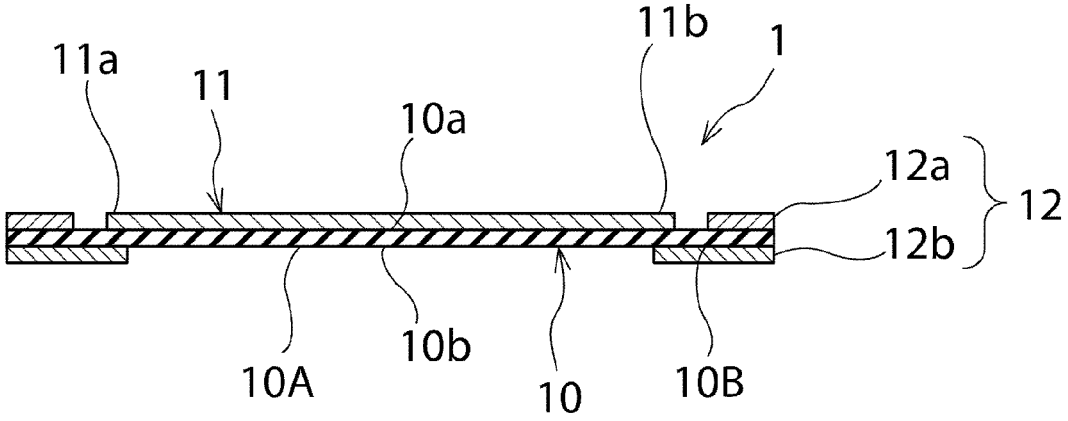
FIG. 2 is a schematic sectional view of the piezoelectric sound component, taken along line II-II of FIG. 1.

FIG. 1 is a schematic sectional view of a piezoelectric sound component according to an embodiment of the present invention. FIG. 2 is a schematic sectional view of the piezoelectric sound component, taken along line II-II of FIG. 1. As illustrated in FIGS. 1 and 2, the piezoelectric sound component 1 includes an elastic resin sheet 10. The resin sheet 10 preferably has a Young's modulus of 1 to 10 MPa and a large loss factor (Tan δ). The resin sheet 10 may be made of a resin such as an acrylic resin, a silicone resin, an ethylene-propylene rubber-based resin, a polyimide resin, or a styrene-butadiene resin. The thickness of the resin sheet 10 is not particularly limited, but may fall within the range of about 10 to 200 μm, for example.

A substantially polygonal piezoelectric diaphragm 11 is attached to at least part of a central portion 10A of the resin sheet 10 on a first main surface 10*a* of the resin sheet 10. Specifically, the piezoelectric diaphragm 11 is substantially rectangular in the embodiment. The piezoelectric diaphragm 11 in the embodiment is attached to the resin sheet 10 by an adhesive agent. Examples of preferably-usable adhesive agents include a pressure sensitive adhesive such as an acrylic adhesive, a silicone adhesive, or a rubber-based adhesive.

The piezoelectric diaphragm 11 includes a piezoelectric plate and a pair of electrodes that apply a voltage to the piezoelectric plate. The piezoelectric diaphragm 11 is a vibration plate that vibrates by bending. The piezoelectric plate may be made of lead zirconate titanate (PZT) or the like. The electrodes may be made of a metal such as Ag, Al, Cu, Au, or Pd, or an alloy containing at least one of these metals. The piezoelectric diaphragm 11 is a vibration plate having multiple ceramic layers stacked on top of one another and sandwiched by the electrodes.

The piezoelectric diaphragm 11 may include protective layers that cover the upper surface and the lower surface thereof. Providing the protective layers prevents the piezoelectric diaphragm 11 from being excessively displaced by an impact due to being dropped. The protective layers may also be used as masking members so that minimum portions of the electrodes are exposed. The protective layers may be made of an epoxy resin, a polyimide resin, or a polyamide-imide resin. The thickness of the protective layers is preferably within a range of about 5 to 20 μm.

A peripheral portion 10B of the resin sheet 10 is held by a casing 12. The casing 12 includes a first casing portion 12*a* and a second casing portion 12*b*. The first casing portion 12*a* is disposed on a piezoelectric-diaphragm-11 side of the resin sheet 10, i.e., disposed on the first main surface 10*a*. The second casing portion 12*b* is disposed on a side of the resin sheet 10 that is opposite to the piezoelectric-diaphragm-11 side, i.e., disposed on a second main surface 10*b*. These first and second casing portions 12*a* and 12*b* hold therebetween the peripheral portion 10B of the resin sheet 10 so that the resin sheet 10 can be fixed in place. The casing 12 may be made of a material including an alloy such as steel use stainless (SUS), a metal, a ceramic, or a rigid resin.

The casing 12 is configured to support corner portions 11*a* to 11*d* of the piezoelectric diaphragm 11. Specifically, the second casing portion 12*b* is superposed with the corner portions 11*a* to 11*d* of the piezoelectric diaphragm 11 in plan view. In the embodiment, the first casing portion 12*a* is not superposed with the piezoelectric diaphragm 11 in plan view, and is thus not in contact with the piezoelectric diaphragm 11. For this reason, the piezoelectric diaphragm 11 is prevented from being damaged by coming into contact with the first casing portion 12*a* during driving of the piezoelectric sound component 1. Nevertheless, in the embodiment of the present invention, the corner portions 11*a* to 11*d* of the piezoelectric diaphragm 11 may be held in such a manner that the first and second casing portions 12*a* and 12*b* hold therebetween the corner portions 11*a* to 11*d* of the piezoelectric diaphragm 11.

The first casing portion 12*a* and the second casing portion 12*b* are not limited to any particular shapes as long as they are able to hold the peripheral portion 10B of the resin sheet 10. For example, the first casing portion 12*a* and the second casing portion 12*b* may each have a frame shape or an angular U-shape.

As described above, the casing 12 in the embodiment is configured to support the corner portions 11*a* to 11*d* of the piezoelectric diaphragm 11 that vibrates by bending. This configuration allows an increase in sound pressure in the low frequency band, leading to an improvement in sound quality in the low frequency band. The increase and the improvement are believed to be due to the following reason. The corner portions 11*a* to 11*d* of the piezoelectric diaphragm 11 which are directly supported serve as fixed ends. Thus, the displacement amount of the piezoelectric diaphragm 11 is increased and the corner portions 11*a* to 11*d* are prevented from being displaced with a phase opposite to that with which the central portion is displaced. These effects will be described in further detail below.

Figure 3:
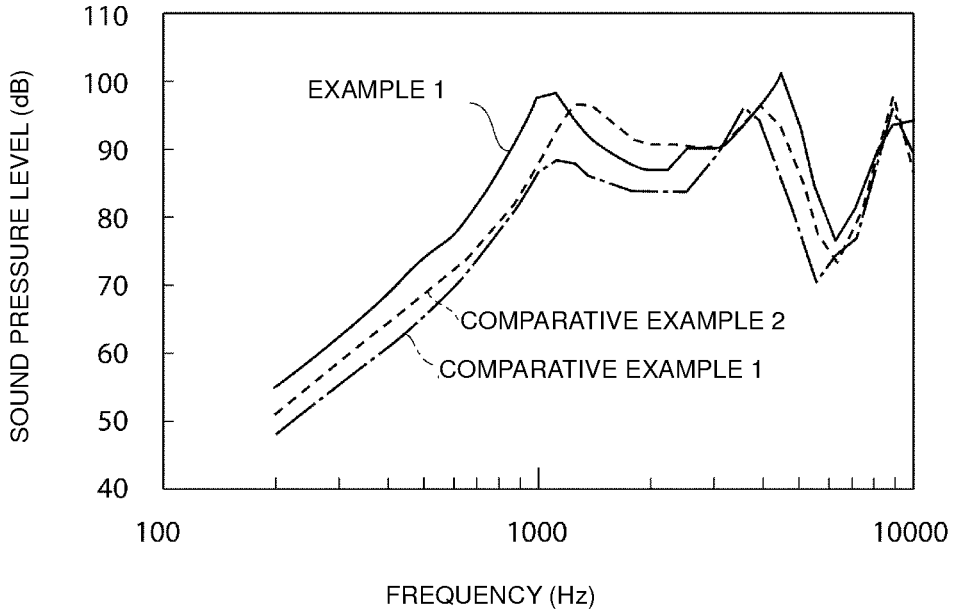
FIG. 3 is a graph representing the relationship between frequencies and sound pressures for piezoelectric sound components according to Example 1 and Comparative Examples 1 and 2.
Figure 4:
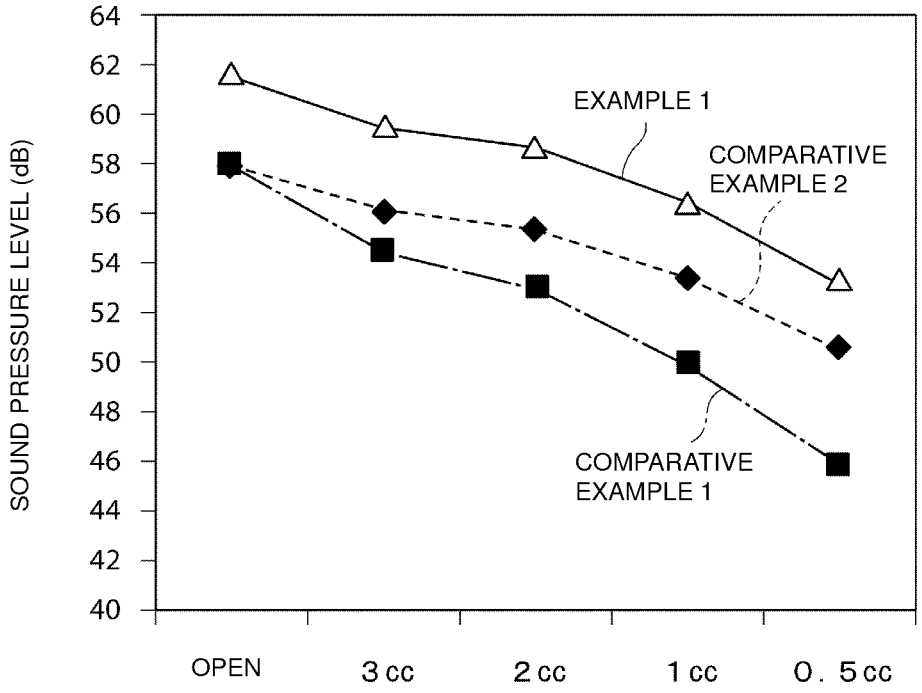
FIG. 4 is a graph representing relationships between the volumes at the back sides and the sound pressures at a frequency of 200 Hz for the piezoelectric sound components according to Example 1 and Comparative Examples 1 and 2.

FIG. 3 is a graph representing sound pressures of piezoelectric sound components according to Example 1 and Comparative Examples 1 and 2. The piezoelectric sound component according to Example 1 has substantially the same configuration as the piezoelectric sound component 1, with the Young's modulus of the resin sheet 10 being 10 MPa. The piezoelectric sound component according to Comparative Example 1 has substantially the same configuration as that of Example 1, except that the corner portions of the piezoelectric diaphragm are not supported by the casing. The piezoelectric sound component according to Comparative Example 2 has substantially the same configuration as that of Comparative Example 1, except that the Young's modulus of the resin sheet is 50 MPa. FIG. 4 is a graph representing relationships between the sound pressures at a frequency of 200 Hz and the volumes at the back sides for the piezoelectric sound components according to Example 1 and Comparative Examples 1 and 2.

The results for Comparative Examples 1 and 2 shown in FIG. 3 reveal that an increase in the Young's modulus of the resin sheet leads to an increase in sound pressure in a frequency band that is higher than the resonance frequency (about 1000 Hz). The results, however, reveal that the increase in the Young's modulus negligibly leads to any increase in sound pressure in a frequency band lower than the resonance frequency. The results for Example 1 and Comparative Example 1 shown in FIG. 3 reveal that supporting the corner portions 11*a* to 11*d* of the piezoelectric diaphragm 11 by use of the casing 12 leads to an increase in sound pressure also in a frequency band lower than the resonance frequency.

In addition, the results shown in FIG. 4 reveal that the above effect, which is obtained by supporting the corner portions 11*a* to 11*d* of the piezoelectric diaphragm 11 by use of the casing 12 so that sound pressure is also increased in a frequency band lower than the resonance frequency, is obtainable irrespective of volumes at the back sides.

Figure 5:
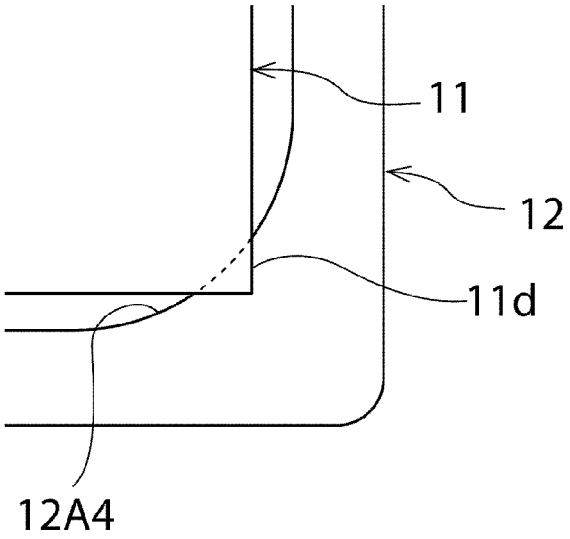
FIG. 5 is a schematic sectional view of an enlarged part of a piezoelectric sound component according to a first modified example.
Figure 6:
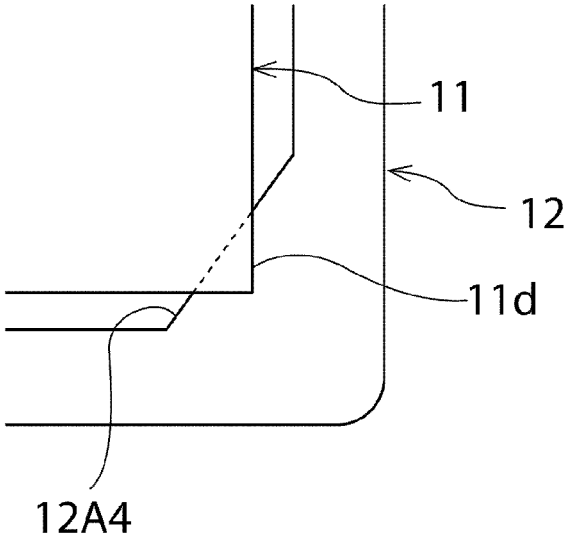
FIG. 6 is a schematic sectional view of an enlarged part of a piezoelectric sound component according to a second modified example.
Figure 7:
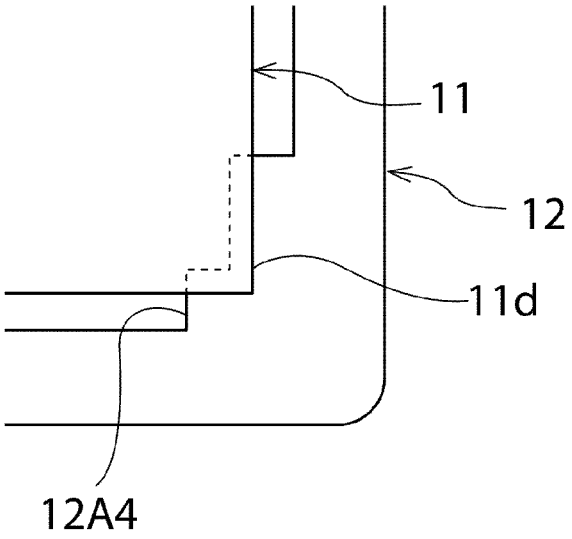
FIG. 7 is a schematic sectional view of an enlarged part of a piezoelectric sound component according to a third modified example.

The embodiment is described by taking, as an example, a case where supporting portions 12A1 to 12A4 of the second casing portion 12*b* for supporting the corner portions 11*a* to 11*d* have shapes that protrude toward the corresponding corner portions 11*a* to 11*d*. The present invention, however, is not limited to these shapes. For example, as illustrated in FIG. 5, the supporting portions 12A1 to 12A4 may have a radius shape that is recessed with respect to the corresponding corner portions 11*a* to 11*d*. Alternatively, the supporting portions 12A1 to 12A4 may have generally triangular shapes as illustrated in FIG. 6, or generally L-shaped shapes as illustrated in FIG. 7.

The length of a shorter side of each of the corner portions 11*a* to 11*d* supported by the supporting portions 12A1 to 12A4 is preferably equal to or less than 10% of the length of a shorter side of the piezoelectric diaphragm 11. The length of a longer side of each of the corner portions 11*a* to 11*d* supported by the supporting portions 12A1 to 12A4 is preferably equal to or less than 10% of the length of a longer side of the piezoelectric diaphragm 11.

While preferred embodiments of the invention have been described above, it is to be understood that variations and modifications will be apparent to those skilled in the art without departing from the scope and spirit of the invention. The scope of the invention, therefore, is to be determined solely by the following claims.

What is claimed is:

1. A piezoelectric sound component comprising:

a resin sheet;

a piezoelectric diaphragm attached to at least part of a central portion of the resin sheet excluding a peripheral portion of the resin sheet, the piezoelectric diaphragm configured to vibrate by bending; and a casing holding the peripheral portion of the resin sheet, wherein the casing supports at least one corner portion of the piezoelectric diaphragm.

2. The piezoelectric sound component according to claim 1, wherein the piezoelectric diaphragm has a substantially polygonal shape.

3. The piezoelectric sound component according to claim 1, wherein the casing includes a first casing portion disposed on a piezoelectric diaphragm side of the resin sheet and a second casing portion disposed on a side of the resin sheet that is opposite to the piezoelectric diaphragm side, the second casing portion and the first casing portion holding therebetween the peripheral portion of the resin sheet.

4. The piezoelectric sound component according to claim 3, wherein the second casing portion is superposed with the at least one corner portion of the piezoelectric diaphragm while the first casing portion is not superposed with the at least one corner portion of the piezoelectric diaphragm.

5. The piezoelectric sound component according to claim 3, wherein the second casing portion is superposed with all corner portions of the piezoelectric diaphragm while the first casing portion is not superposed with any corner portions of the piezoelectric diaphragm.

6. The piezoelectric sound component according to claim 1 wherein the piezoelectric diaphragm is substantially rectangular.

7. The piezoelectric sound component according to claim 1, wherein the resin sheet has a Young's modulus of 1 to 10 MPa.

8. The piezoelectric sound component according to claim 1, wherein the resin sheet is made from a material selected from the group consisting of an acrylic resin, a silicone resin, an ethylene-propylene rubber-based resin, a polyimide resin, and a styrene-butadiene resin.

9. The piezoelectric sound component according to claim 1, wherein the resin sheet has a thickness in a range of about 10 to 200 μm.

10. The piezoelectric sound component according to claim 1, wherein the casing has a part superposed with the at least one corner portion of the piezoelectric diaphragm in a direction perpendicular to the piezoelectric diaphragm.

11. The piezoelectric sound component according to claim 1, wherein the casing includes supporting portions for supporting the at least one corner of the piezoelectric diaphragm.

12. The piezoelectric sound component according to claim 11, wherein the supporting portions are shaped so as to protrude from the casing toward an opposite support portion.

13. The piezoelectric sound component according to claim 11, wherein the supporting portions have a radius shape that is recessed with respect to an opposite support portion.

14. The piezoelectric sound component according to claim 11, wherein the supporting portions are triangular shaped.

15. The piezoelectric sound component according to claim 11, wherein the supporting portions are L-shaped.

* * * * *